US010696046B2

(12) United States Patent
Kawahara et al.

(10) Patent No.: US 10,696,046 B2
(45) Date of Patent: Jun. 30, 2020

(54) LIQUID DISCHARGE HEAD, LIQUID DISCHARGE DEVICE, AND LIQUID DISCHARGE APPARATUS

(71) Applicants: Koji Kawahara, Ibaraki (JP); Takahiro Yoshida, Kanagawa (JP)

(72) Inventors: Koji Kawahara, Ibaraki (JP); Takahiro Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/237,798

(22) Filed: Jan. 2, 2019

(65) Prior Publication Data

US 2019/0240978 A1 Aug. 8, 2019

(30) Foreign Application Priority Data

Feb. 2, 2018 (JP) ..... 2018-017602

(51) Int. Cl.

| | |
|---|---|
| ***B41J 2/14*** | (2006.01) |
| ***B41J 2/175*** | (2006.01) |
| ***B41J 2/15*** | (2006.01) |
| ***B41M 7/00*** | (2006.01) |

(52) U.S. Cl.

CPC ..... *B41J 2/14233* (2013.01); *B41J 2/14274* (2013.01); *B41J 2/15* (2013.01); *B41J 2/17563* (2013.01); *B41J 2/17596* (2013.01); *B41M 7/00* (2013.01); *B41J 2002/14403* (2013.01); *B41J 2002/14419* (2013.01); *B41J 2202/11* (2013.01); *B41J 2202/12* (2013.01)

(58) Field of Classification Search

CPC ..... B41J 2002/14306; B41J 2/14145; B41J 2/14233; B41J 2/1721; B41J 2/17503

USPC ..... 347/20, 44, 54, 68

See application file for complete search history.

(56) References Cited

U.S. PATENT DOCUMENTS

| | | | | |
|---|---|---|---|---|
| 10,179,452 | B2 * | 1/2019 | Iwama | B41J 2/175 |
| 2008/0143793 | A1 | 6/2008 | Okuda | |
| 2011/0069118 | A1 | 3/2011 | Ohzeki et al. | |
| 2013/0208059 | A1 | 8/2013 | Arimoto | |
| 2015/0062255 | A1 | 3/2015 | Sasaki | |
| 2016/0185113 | A1 | 6/2016 | Yoshida et al. | |
| 2017/0120602 | A1 | 5/2017 | Nakai et al. | |
| 2017/0253034 | A1 | 9/2017 | Tsukamoto | |
| 2017/0297333 | A1 | 10/2017 | Kohda et al. | |
| 2018/0072066 | A1 | 3/2018 | Yoneta | |

FOREIGN PATENT DOCUMENTS

| | | |
|---|---|---|
| JP | 2008-284739 | 11/2008 |
| JP | 2009-179049 | 8/2009 |
| JP | 2017-119391 | 7/2017 |

* cited by examiner

*Primary Examiner* — An H Do

(74) *Attorney, Agent, or Firm* — Oblon, McClelland, Maier & Neustadt, L.L.P.

(57) ABSTRACT

A liquid discharge head includes a plurality of nozzles to discharge a liquid, a plurality of individual chambers communicating with the plurality of nozzles, respectively, a supply-side common chamber communicating with each of the plurality of individual chambers, and a recovery-side common chamber communicating with each of the plurality of individual chambers. The supply-side common chamber and a part of the recovery-side common chamber are aligned in a longitudinal direction of the plurality of individual chambers orthogonal to a nozzle array direction along Which the plurality of nozzles is arrayed.

10 Claims, 17 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-017602, filed on Feb. 2, 2018, in the Japan Patent Office, the entire disclosure of which is incorporated by reference herein.

BACKGROUND

Technical Field

The present disclosure relates to a liquid discharge head, a liquid discharge device, and a liquid discharge apparatus.

Description of the Related Art

As a liquid discharge head, there is a flow-through type head (circulation-type head) including: a supply channel to an individual chamber communicating with a nozzle; a recovery channel communicating with an individual chamber; a liquid supply opening communicating with the supply channel; and a liquid outlet port, communicating with the recovery channel.

For example, a liquid discharge head is known that includes a supply-side common chamber communicating with a plurality of individual chambers and a recovery-side common chamber communicating with the plurality of individual chambers, and a part of the supply -side common chamber and the recovery-side common chamber are aligned.

SUMMARY

In an aspect of this disclosure, a novel liquid discharge head includes a plurality of nozzles to discharge a liquid, a plurality of individual chambers communicating with the plurality of nozzles, respectively, a supply-side common chamber communicating with each of the plurality of individual chambers, and a recovery-side common chamber communicating with each of the plurality of individual chambers. The supply-side common chamber and a part of the recovery-side common chamber are aligned in a longitudinal direction Of the plurality of individual chambers orthogonal to a nozzle array direction along which the plurality of nozzles is arrayed.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
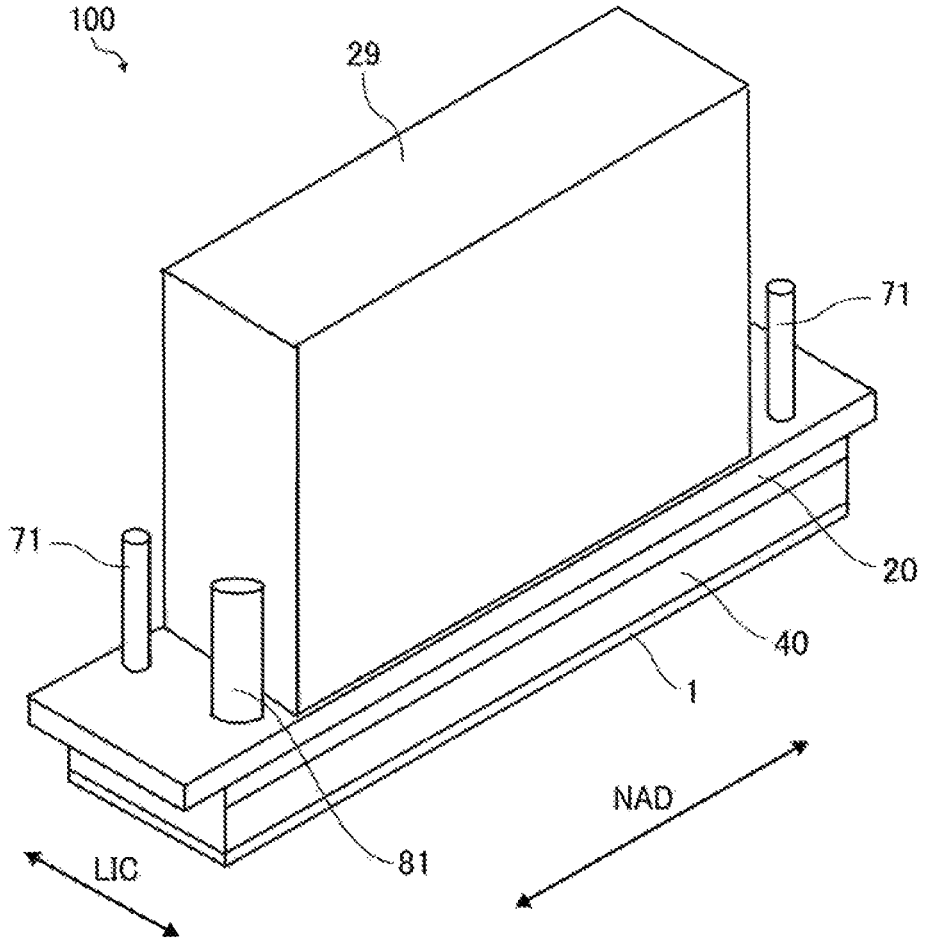
FIG. 1 is an explanatory external perspective view of a liquid discharge head according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are-described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments of the present disclosure is described referring to the accompanying drawings. An exemplary liquid discharge head 100 according to a first embodiment of the present disclosure is described referring to FIGS. 1 to 3.

FIG. 1 is an explanatory external perspective view of a liquid discharge head 100.

Figure 2:
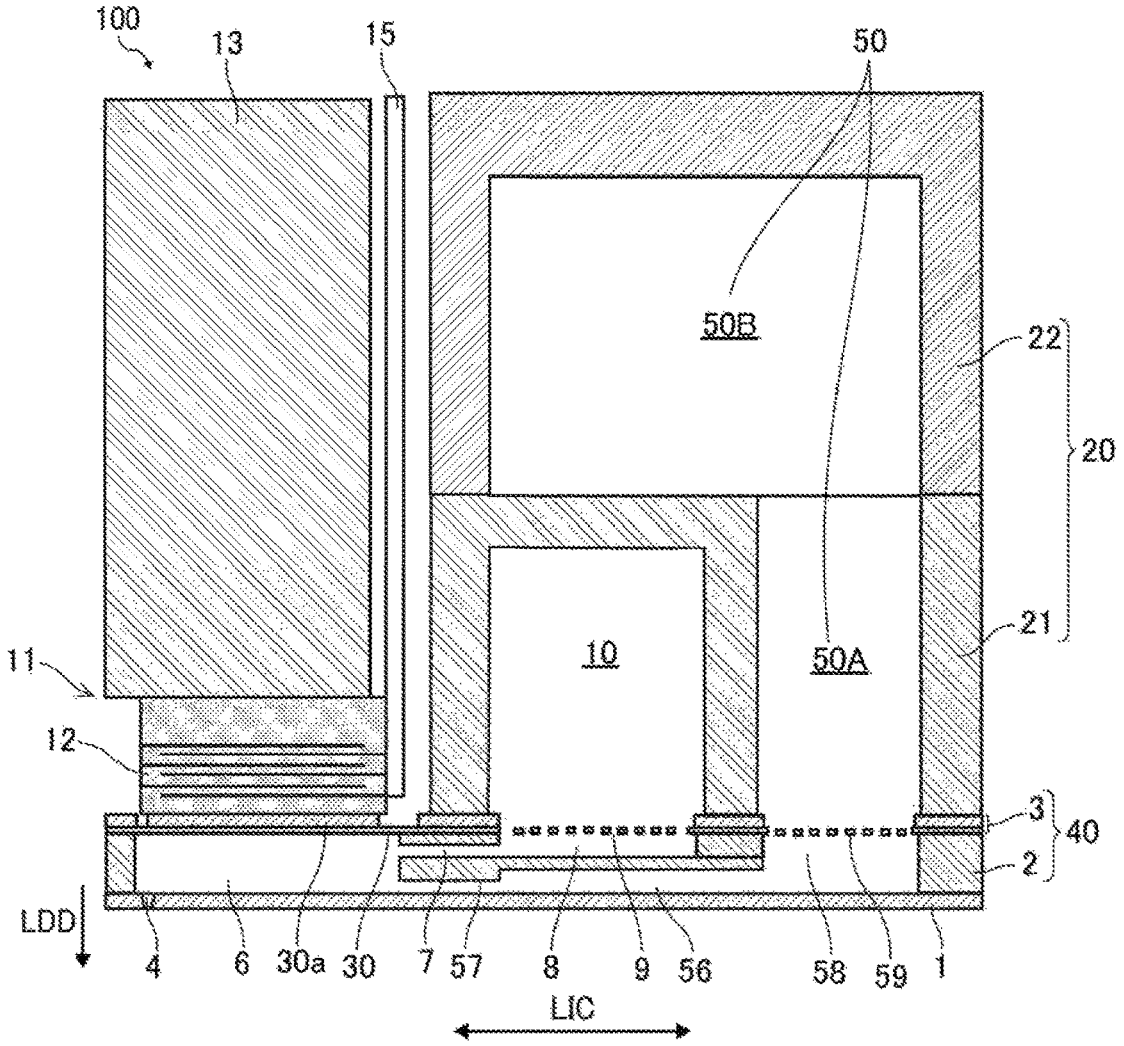
FIG. 2 is an explanatory cross-sectional view in a longitudinal direction of a liquid chamber orthogonal to a nozzle array direction of the liquid discharge head.

FIG. 2 is an explanatory cross-sectional view in a longitudinal direction of an individual chamber 6 of the liquid discharge head 100 orthogonal to a nozzle array direction of the liquid discharge head 100.

Figure 3:
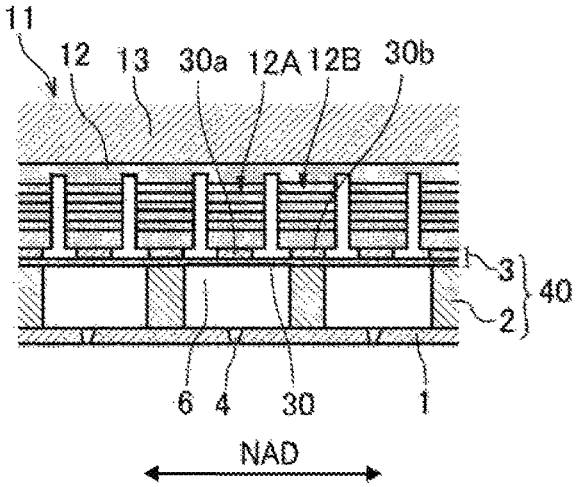
FIG. 3 is an explanatory cross-sectional view in the longitudinal direction of the liquid chamber orthogonal to the nozzle array direction of the liquid discharge head.

FIG. 3 is an explanatory cross-sectional view in the longitudinal direction of the individual chamber 6 of the liquid discharge head 100 orthogonal to the nozzle array direction of the liquid discharge head 100.

Hereinafter, the liquid discharge head is also simply referred to as a "head".

The longitudinal direction of the individual chamber 6 is indicated by arrow LIC in FIGS. 1 and 2. The nozzle array direction is indicated by arrow NAD in FIGS. 1 and 3.

The head 100 includes a nozzle plate 1, a channel plate 2, and a diaphragm member 3 provided as a wall member, and the plates and the member are laminated and joined. The head 100 further includes: a piezoelectric actuator 11 to displace the diaphragm member 3; a common chamber member 20; and a cover 29.

The nozzle plate 1 includes a plurality of nozzles 4 to discharge liquid.

The channel plate 2 forms an individual chamber 6 communicating with a nozzle 4, a supply-side fluid resistance portion 7 communicating with individual chamber 6, and a supply-side introduction portion 8 communicating with the supply-side fluid resistance portion 7. The supply-side introduction portion 8 communicating with a supply-side common chamber 10 formed in the common chamber member 20 via the supply-side filter portion 9 formed at the diaphragm member 3.

Thus, a filter portion (supply-side filter portion 9) is arranged to face the supply-side common chamber 10. The supply-side filter portion 9 and a recovery-side filter portion 59 may be arranged to face the supply-side common chamber 10 and the part of the recovery -side common chamber 50 (an upstream recovery-side common chamber 50A), respectively.

The diaphragm member 3 is the wall member forming a wall surface of the individual chamber 6 of the channel plate 2. The diaphragm member 3 has a two-layer structure (but not limited to this structure) in which: a first layer forming a thin portion and a second layer forming a thick portion are formed from the channel plate 2 side; and a deformable vibration region 30 is formed in a portion that is included in the first layer and corresponds to the individual chamber 6.

Additionally, a piezoelectric actuator 11 is arranged on a side of the diaphragm member 3 opposing to the side where the individual chamber 6 is located, and the piezoelectric actuator 11 includes an electromechanical conversion element functioning as a driving unit (an actuator unit and a pressure generating unit) to deform the vibration region 30 of the diaphragm member 3.

The piezoelectric actuator 11 includes a piezoelectric member 12 joined onto a base member 13, and the piezoelectric member 12 is subject to groove processing by a half cut dicing to form required number of columnar piezoelectric elements 12A and 12B for the one piezoelectric member 12 at a predetermined interval like a comb shape.

Here, the piezoelectric element 12A of the piezoelectric member 12 includes a piezoelectric element 12A to be driven by applying a drive waveform, and the piezoelectric element 12B is simply used as a support post without applying any drive waveform. However, all of the piezoelectric elements 12A and 12B can also be used as piezoelectric elements to be driven.

The piezoelectric element 12A is joined to a protrusion 30*a* that is an island-shaped thick portion in the vibration region 30 of the diaphragm member 3. The piezoelectric element 12B is joined to a protrusion 30*b* that is a thick portion of the diaphragm member 3.

The piezoelectric member 12 is formed by alternately laminating a piezoelectric layer and an internal electrode. Each internal electrode is drawn out to an end face to form an external electrode, and a flexible wiring member 15 is coupled to the external electrode.

Additionally, the channel plate 2 forms: a recovery-side fluid resistance portion 57 along a surface direction of the channel plate 2 communicating with each individual chamber 6; a recovery-side individual channel 56; and a recovery-side introduction portion 58. The recovery-side introduction portion 58 communicates with the recovery-side common chamber 50 in the common chamber member 20 via a recovery-side filter portion 59 in the diaphragm member 3.

The common chamber member 20 forms the supply-side common chamber 10 and the recovery-side common chanter 50. The common chamber member 20 includes: a supply opening 71 (supply port) to supply liquid from an external circulation path to the supply-side common chamber 10; and a recovery opening 81 (recovery port) through which liquid is recovered in the external circulation path.

In the head 100 having the above-described structure, for example, when voltage applied to the piezoelectric element 12A is decreased from reference potential, the piezoelectric element 12A is contracted and the vibration region 30 of the diaphragm member 3 lowers, and then the volume of the individual chamber 6 is expanded. As a result, liquid flows into the individual chamber 6.

After that, when the voltage applied to the piezoelectric element 12A is increased to extend the piezoelectric element 12A in the lamination direction and then the vibration region 30 of the diaphragm member 3 is deformed in a direction toward the nozzle 4 to contract the volume of the individual chamber 6, the liquid inside the individual chamber 6 is pressurized to discharge the liquid from the nozzle 4 in a discharge direction of the liquid from the nozzle 4. The discharge direction of the liquid from the plurality of nozzles 4 is indicated by arrow LDD in FIG. 2. The discharge direction LDD is parallel to the lamination direction of the piezoelectric elements 12A and 12B.

Furthermore, when the voltage applied to the piezoelectric element 12A is set back to the reference potential to move back the vibration region 30 of the diaphragm member 3 to an initial position, the individual chamber 6 is expanded to generate negative pressure. Accordingly, at this point, the individual chamber 6 is filled with liquid from the supply-side common chamber 10. After vibration of a meniscus surface of the nozzle 4 is attenuated and stabilized, operation is shifted to next discharge operation.

Additionally, liquid not discharged from a nozzle 4 passes through the nozzle 4 and is discharged to the recovery-side common chamber 50 through the recovery-side fluid resistance portion 57, the recovery-side individual channel 56, the recovery-side introduction portion 58, and the recovery-side filter portion 59. Then, the liquid is supplied again from the recovery-side common chamber 50 to the supply-side common chamber 10 through the external circulation path. Even when the liquid is not being discharged, the liquid flows from the supply-side common chamber 10 to the recovery-side common chamber 50 and is further supplied again to the supply-side common chamber 10 through the external circulation path.

Note that a method of driving the head 100 is not limited to the above-described example (pull/push drive), but pull drive, push drive, and the like can be performed in accordance with a way of applying a drive waveform Next, details of portions relating to the supply-side common chamber and the recovery-side common chamber in this head 100 is described.

In the present embodiment, the channel plate 2 and the diaphragm member 3 provided as the wall member constitute the channel member 40.

On the other hand, the common chamber member 20 includes the first common chamber member 21 and the second common chamber member 22. The first common chamber member 21 is joined to the diaphragm member 3 side of the channel member 40, and the second common chamber member 22 is laminated and jointed to the first common chamber member 21.

Here, the first common chamber member 21 forms the supply-side common chamber 10 communicating with the supply-side introduction portion 8 and an upstream recovery-side common chamber 50A that is a part of the recovery-side common chamber 50 communicating with the recovery-side introduction portion 58. Additionally, the second common chamber member 22 forms a downstream recovery-side common chamber 50B that is a remaining part of the recovery-side common chamber 50.

Here, the supply-side common chamber 10 and a part of the recovery-side common chamber 50 (upstream recovery-side common chamber 50A) are aligned in the longitudinal direction LIC of the individual, chamber 6 orthogonal to a nozzle array direction NAD along which the plurality of nozzles 4 is arrayed.

The supply-side common chamber 10 is arranged at a position where the supply-side common chamber 10 is projected to Within the recovery-side common chamber 50.

That is, the supply-side common chamber 10 is disposed to overlap with another part of the recovery-side common chamber 50 (downstream recovery-side common chamber 50B) in a discharge direction LDD of the liquid from the plurality of nozzles 4. The discharge direction LDD is orthogonal to the longitudinal direction LIC and the nozzle array direction NAD.

Thus, the supply-side common chamber 10 and the recovery-side common chamber 50 are aligned in the longitudinal direction LIC of the individual chamber 6 orthogonal to the nozzle array direction NAD, and the supply-side common chamber 10 is arranged at the position where the supply-side common chamber 10 is projected to within the recovery-side common chamber 50.

With this structure, a width of the head 100 in the longitudinal direction LIC of the individual chamber 6 orthogonal to the nozzle array direction NAD can be reduced, and size increase of the head 100 can be suppressed. Additionally, even when the area of the supply -side filter portion is broadened, increase in fluid resistance in the recovery-side common chamber can be suppressed.

Figure 4A:
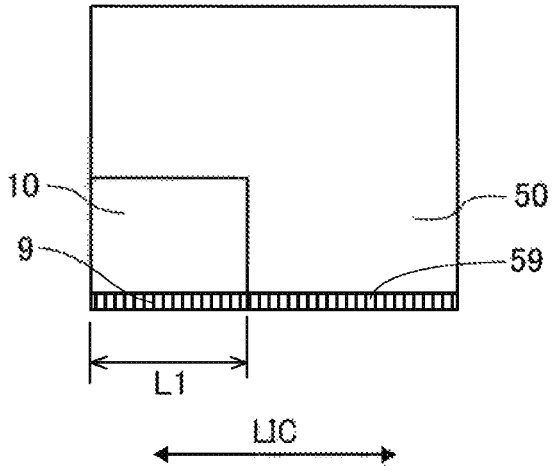
FIGS. 4A and 4B are explanatory schematic views to describe a case where the area of a supply-side filter portion is broadened in a supply-side common chamber in the present embodiment.
Figure 4B:
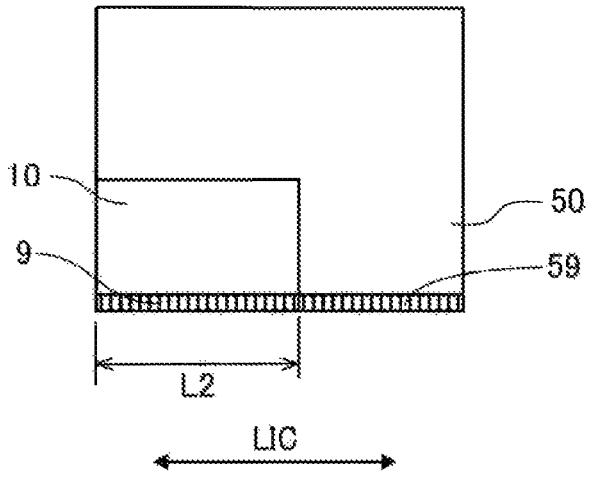
Figure 5A:
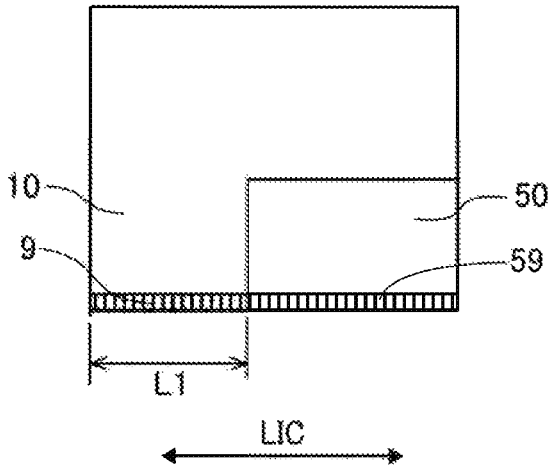
FIGS. 5A and 5B are explanatory schematic views to describe a case where the area of a supply-side filter portion is broadened in a supply-side common chamber in a comparative example.
Figure 5B:
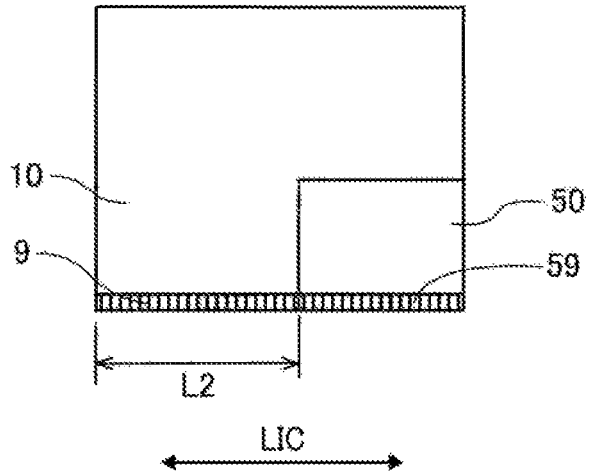

This point is described referring to FIGS. 4 and 5. FIGS. 4A and 4B are explanatory schematic views to describe a case where the area of the supply-side filter portion is broadened in the supply-side common chamber in the present embodiment, and FIGS. 5A and 5B are explanatory schematic views to describe a case where the area of a supply-side filter portion is broadened in a supply-side common chamber in a comparative example.

First, in the comparative example illustrated in FIGS. 5A and 5B, a part of the supply-side common chamber 10 and the recovery-side common chamber 50 are aligned in the longitudinal direction LIC of the individual chamber 6 orthogonal to a nozzle array direction NAD, and the recovery-side common chamber 50 is arranged at a position where the recovery-side common chamber 50 projected to within the supply-side common chamber 10.

In the structure of this comparative example, in a case where the supply-side filter portion 9 having a width L1 in the longitudinal direction LIC of the individual chamber 6 orthogonal to the nozzle array direction NAD is arranged as illustrated in FIG. 5A, fluid resistance is increased due to clogging at the supply-side filter portion 9 due to air bubbles, foreign matters, and the like. Accordingly, in a case where the width of the supply-side filter portion 9 is increased to a width L2 (the area is increased) as illustrated in FIG. 5B, a width of the recovery-side common chamber 50 is reduced, and fluid resistance is increased.

In contrast, in the present embodiment, the supply-side common chamber 10 and a part of the recovery-side common chamber 50 are aligned in the longitudinal direction LIC of the-individual chamber 6 orthogonal to the nozzle array direction NAD as illustrated in FIGS. 4A and 4B, and the supply-side common chamber 10 is arranged at the position where the supply-side common chamber 10 is projected to within the recovery-side common chamber 50.

Therefore, in the structure of the present embodiment also, in a case where the supply-side filter portion 9 having a width LI in the longitudinal direction LIC of the individual chamber 6 orthogonal to the nozzle array direction NAD is arranged as illustrated in FIG. 4A, fluid resistance is increased due to clogging at the supply-side filter portion 9 due to air bubbles, foreign matters, and the like. Accordingly, in a case where the width of the supply-side filter portion 9 is increased to a width L2 (the area is increased) as illustrated in FIG. 4B, a width of the part of the recovery-side common chamber 50 (upstream recovery -side common chamber 50A) is narrowed.

Thus, a width of the supply-side common chamber 10 is wider than a width of the part of the-recovery-side common chamber 50 (upstream recovery-side common chamber 50A) in the longitudinal direction LIC of the individual chamber 6.

However, in the present embodiment, since the recovery-side common chamber 50 includes the downstream recovery-side common chamber 50B larger than the upstream recovery-side common chamber 50A, increase in the fluid resistance in the recovery-side common chamber 50 can be suppressed.

Figure 6:
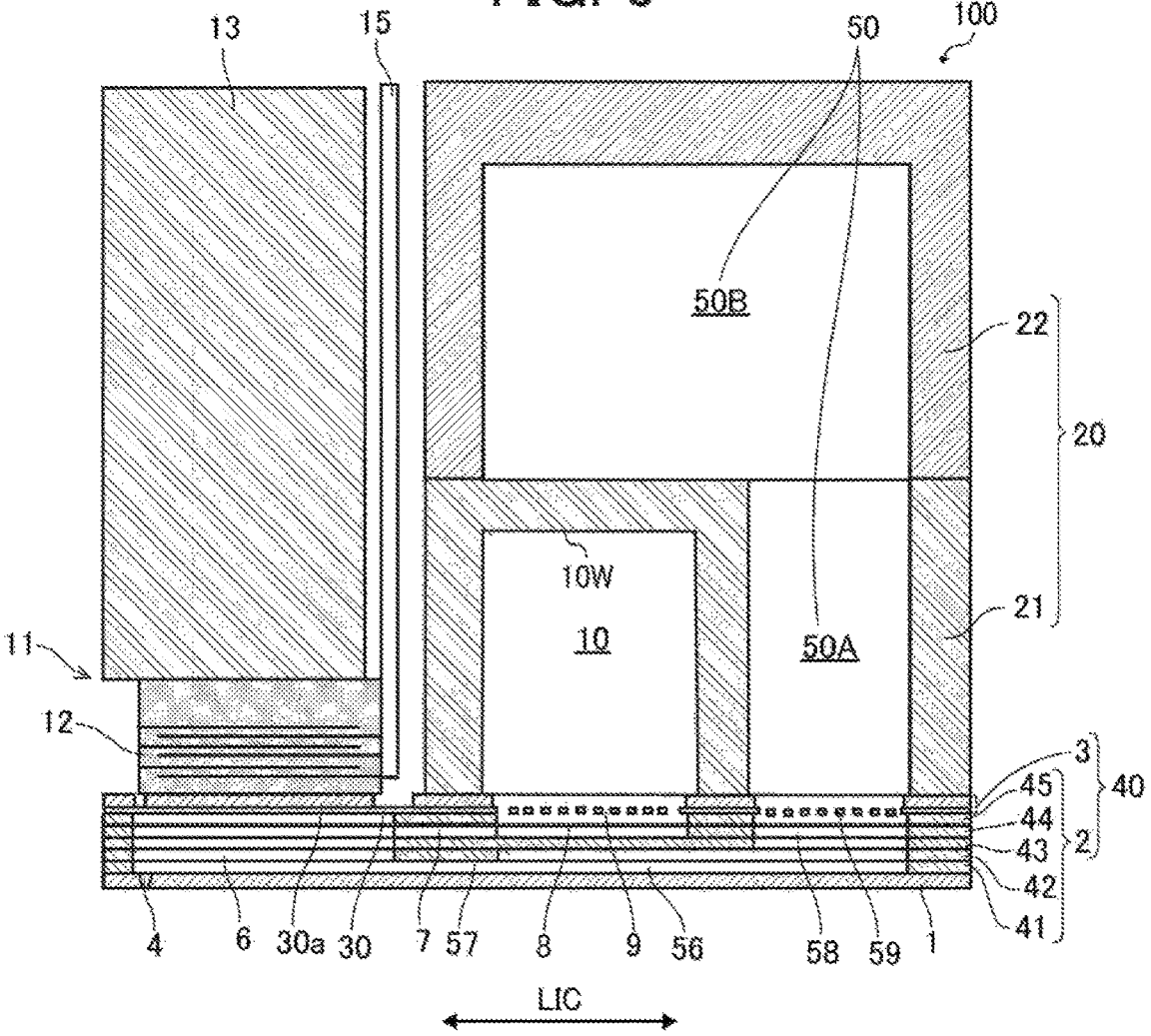
FIG. 6 is an explanatory cross-sectional view in the longitudinal direction of the liquid chamber orthogonal to a nozzle array direction of the liquid discharge head according to a second embodiment of the present disclosure.
Figure 7:
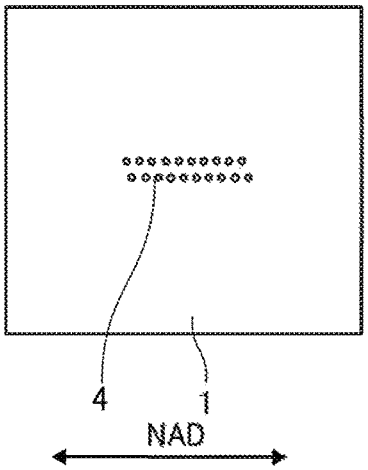
FIG. 7 is an explanatory plan view of a nozzle plate of the liquid discharge head.
Figure 8A:
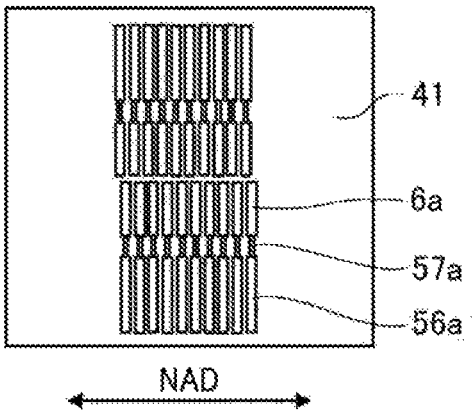
FIGS. 8A to 8F are explanatory plan views of respective members constituting a channel member of the liquid discharge head.
Figure 8B:
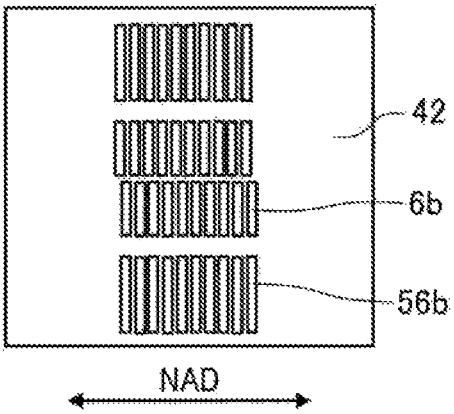
Figure 8C:
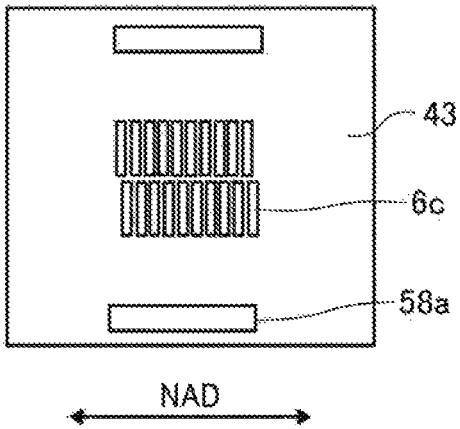
Figure 8D:
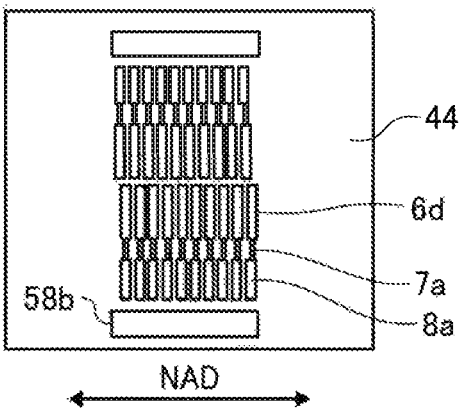
Figure 8E:
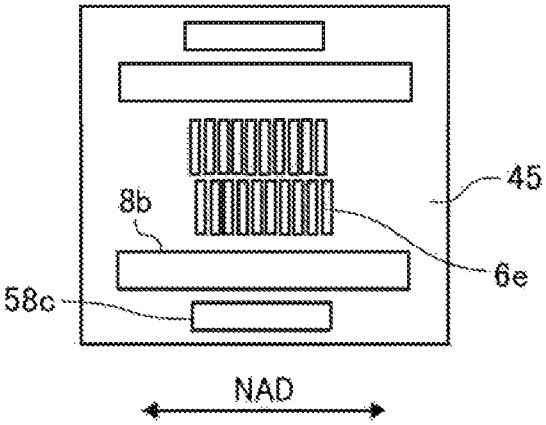
Figure 8F:
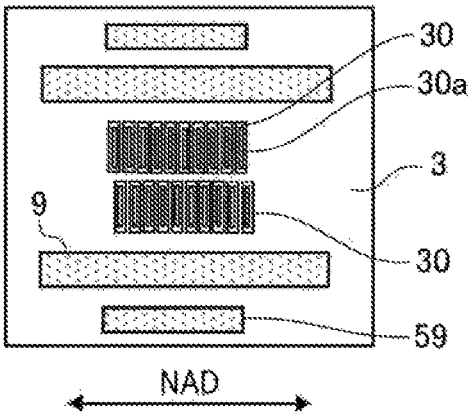
Figure 9A:
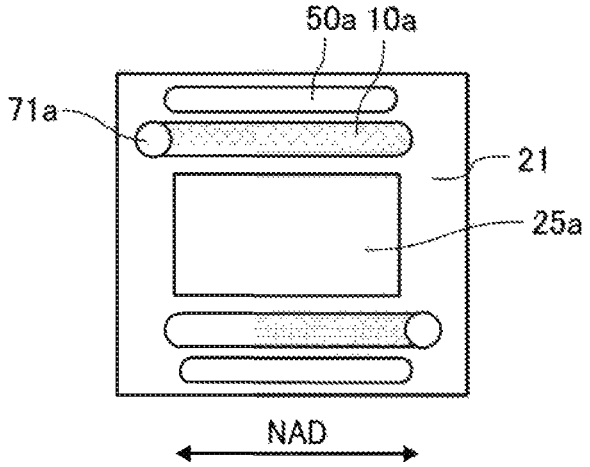
FIGS. 9A and 9B are explanatory plan views of respective members constituting a common chamber member of the liquid discharge head.
Figure 9B:
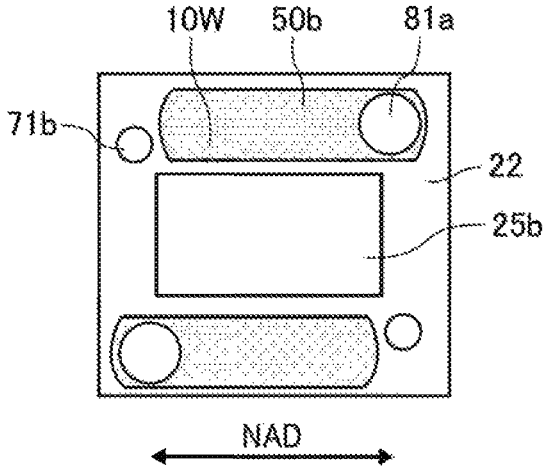

Next, a head 100 according to a second embodiment of the present disclosure is described referring to FIGS. 6 to 9B. FIG. 6 is an explanatory cross-sectional view in a longitudinal direction LIC of the individual chamber 6 orthogonal to a nozzle array direction NAD of the head 100, FIG. 7 is an explanatory plan view of a nozzle plate of the head 100, FIGS. 8A to 8F are explanatory plan views of respective members constituting a channel member of the head 100, and FIGS. 9A and 9B are explanatory plan views of respective members constituting a common chamber member of the head 100.

In the present embodiment, the channel plate 2 is formed by laminating and joining a plurality of plate members 41 to 45 (thin layer members) from a nozzle plate 1 side, and these plate members 41 to 45 and a diaphragm member 3 are laminated and joined to constitute a channel member 40.

Similar to a first embodiment described above, a common chamber member 20 includes a first common chamber member 21 and a second common chamber member 22.

Here, a plurality of nozzles 4 is arranged in a zigzag manner on the nozzle plate 1 as illustrated in FIG. 7.

As illustrated in FIG. 8A, the plate member 41 constituting the channel plate 2 includes: a through-groove (meaning a through-hole shaped like a groove) 6*a* constituting an individual chamber 6; and through-grooves 57*a* and 56*a* constituting a recovery-side fluid resistance portion 57 and a recovery-side individual channel 56.

Similarly, as illustrated in FIG. 8B, the plate member 42 includes: a through-groove 6*b* constituting an individual chamber 6; and a through-groove 56*b* constituting the recovery -side individual channel 56.

Similarly, as illustrated in FIG. 8C, the plate member 43 includes: a through-groove 6*c* constituting an individual chamber 6; and a through-groove 58*a* constituting a recovery -side introduction portion 58 and having a longitudinal direction in the nozzle array direction NAD.

Similarly, as illustrated in FIG. 8D, the plate member 44 includes: a through-groove 6*d* constituting an individual chamber 6, a through-groove 7*a* to be a supply-side fluid resistance portion 7; and a through-groove 8*a* constituting a supply-side introduction portion 8; and a through-groove 58*b* constituting the-recovery-side introduction portion 58 and having a longitudinal direction in the nozzle array direction NAD.

Similarly, as illustrated in FIG. 8E, the plate member 45 includes: a through-groove 6*e* constituting an individual chamber 6; a through-groove 8*b* (to be a liquid chamber on a filter downstream side) constituting the supply-side introduction portion 8 and having a longitudinal direction in the nozzle array direction NAD; and a through-groove 58*c* constituting the recovery-side introduction portion 58 and having a longitudinal direction in the nozzle array direction NAD.

As illustrated in FIG. 8F, the diaphragm member 3 includes a vibration region 30, a supply-side filter portion 9, and a recovery-side filter portion 59.

As illustrated in FIG. 9A, the first common chamber member 21 constituting the common chamber member 20 includes: a through-hole 25*a* for a piezoelectric actuator; a groove 10*a* having a bottom and provided to be a supply-side common chamber 10; and a through-groove 50*a* to be an upstream recovery-side common chamber 50A.

Similarly, as illustrated in FIG. 9B, the second common chamber member 22 includes: a through-hole 25*b* for a piezoelectric actuator; and a groove 50*b* to be a downstream recovery-side common chamber 50B.

Additionally, the second common chamber member 22 includes a through-hole 81*a* to allow communication between one end portion in the nozzle array direction NAD of the recovery-side common chamber 50 and a recovery port 81.

Similarly, the first common chamber member 21 and the second common chamber member 22 include through-holes 71*a* and 71*b* to allow communication between another end portion in the nozzle array direction NAD of the supply-side common chamber 10 (end portion opposite to the through-hole 81*a*) and a supply port 71.

Thus, the head 100 includes two laminated members (first common chamber member 21 and second common chamber member 22) laminated in a lamination direction. The first common chamber member 21 and the second common chamber member 22 contact with each other.

One of the two laminated members (first common chamber member 21) includes a first through-hole portion (through-groove 50*a*) to be the part of the recovery-side common chamber (upstream recovery-side common chamber 50A) and a second through-hole portion (groove 10*a*) to be the supply-side common chamber 10. Another of the two laminated members (second common chamber member 22) includes a third through-hole portion (groove 50*b*) to be another part of the recovery-side common chamber (downstream recovery -side common chamber 50B).

A bottom wall of the groove 50*b* serves as a wall 10W (see FIGS. 6 and 9B) of the supply-side common chamber 10 disposed above the second through-hole portion (groove 10*a*). Thus, the second common chamber member 22 includes the wall 10W of the supply -side common chamber 10 and the third through-hole portion (groove 50*b*) to be another part of the recovery-side common chamber (downstream recovery-side common chamber 50B).

Note that a groove having a bottom is indicated in a colored manner in FIGS. 9A and 9B (the same is applied in the following drawings).

Since the channel member are thus formed by laminating and joining the plurality of plate members, it is possible to form complex channels with a simple structure.

Figure 10A:
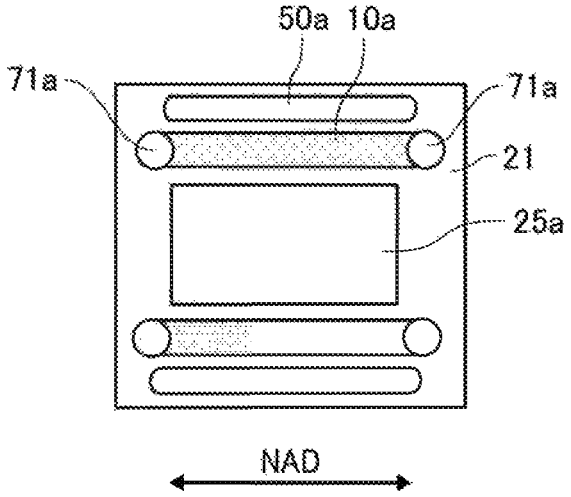
FIGS. 10A and 10B are explanatory plan views of a common chamber member of a liquid discharge head according to a third embodiment of the present disclosure.
Figure 10B:
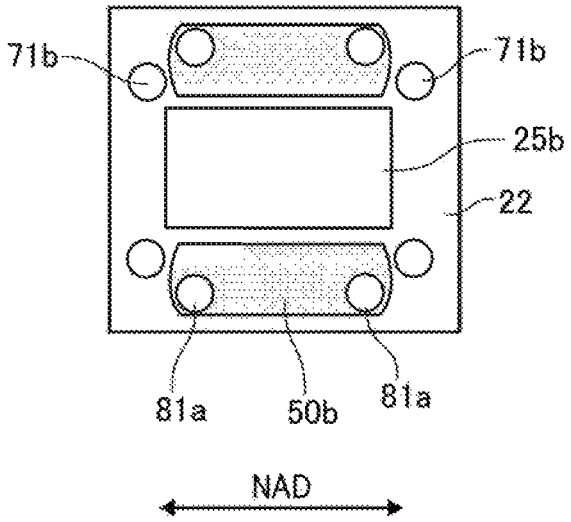

Next, a head 100 according to a third embodiment of the present disclosure is described referring to FIGS. 10A and 10B. FIGS. 10A and 10B are explanatory plan views of a common chamber member of the head 100. FIG. 10A is an explanatory plan view of a first common chamber member, and FIG. 10B is an explanatory plan view of a second common chamber member.

In the present embodiment, the first common chamber member 21 includes through -holes 71*a* which are provided at both end portions of a supply-side common chamber 10 in a nozzle array direction NAD communicating with a supply port 71. The second common chamber member 22 includes: through-holes 71*b* provided at both end portions in the nozzle array direction NAD of the supply-side common chamber 10 and communicating with the supply port 71; and through-holes 81*a* provided at both end portions in the nozzle array direction NAD of a recovery-side common chamber 50 and communicating with a recovery port 81.

With this structure, liquid is supplied to the supply-side common chamber 10 from both side, and occurrence of refill shortage can be reduced.

Figure 11A:
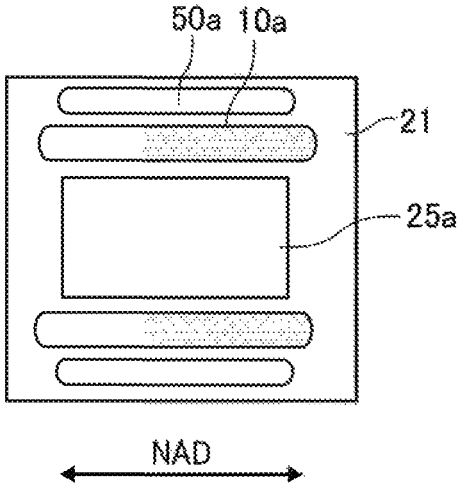
FIGS. 11A and 11B are explanatory plan views of a first common chamber member of a liquid discharge head according to a fourth embodiment of the present disclosure.
Figure 11B:
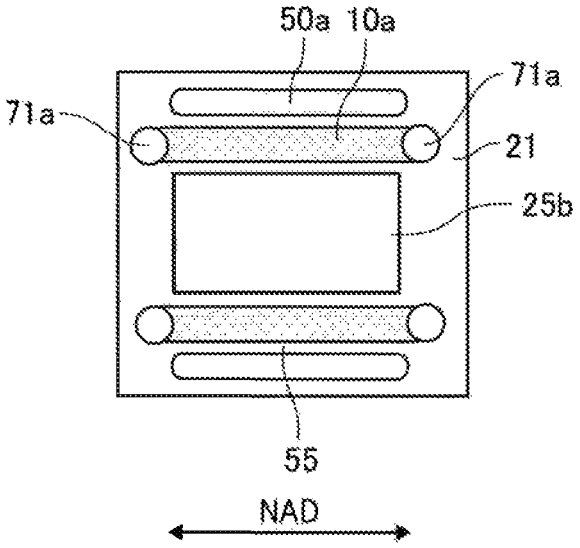

Next, a head 100 according to a fourth embodiment of the present disclosure is described referring to FIGS. 11A and 11B. FIGS. 11A and 11B are explanatory plan views of a first common chamber member of the head 100.

In the present embodiment, as illustrated in FIG. 11A, a first common chamber member 21 includes: a groove 10*a* to be a supply-side common chamber 10 formed by half etching; and a through-groove 50*a* to be an upstream recovery-side common chamber 50A formed by full etching.

Additionally, as illustrated in FIG. 11B, a through-hole 71*a* is opened at a portion corresponding to a supply port 71 by applying laser processing to the half-etched portion.

With this structure, a thin partition wall 55 can be formed with high accuracy between the supply-side common chamber 10 and the upstream recovery-side common chamber 50A of a recovery-side common chamber 50.

Figure 12:
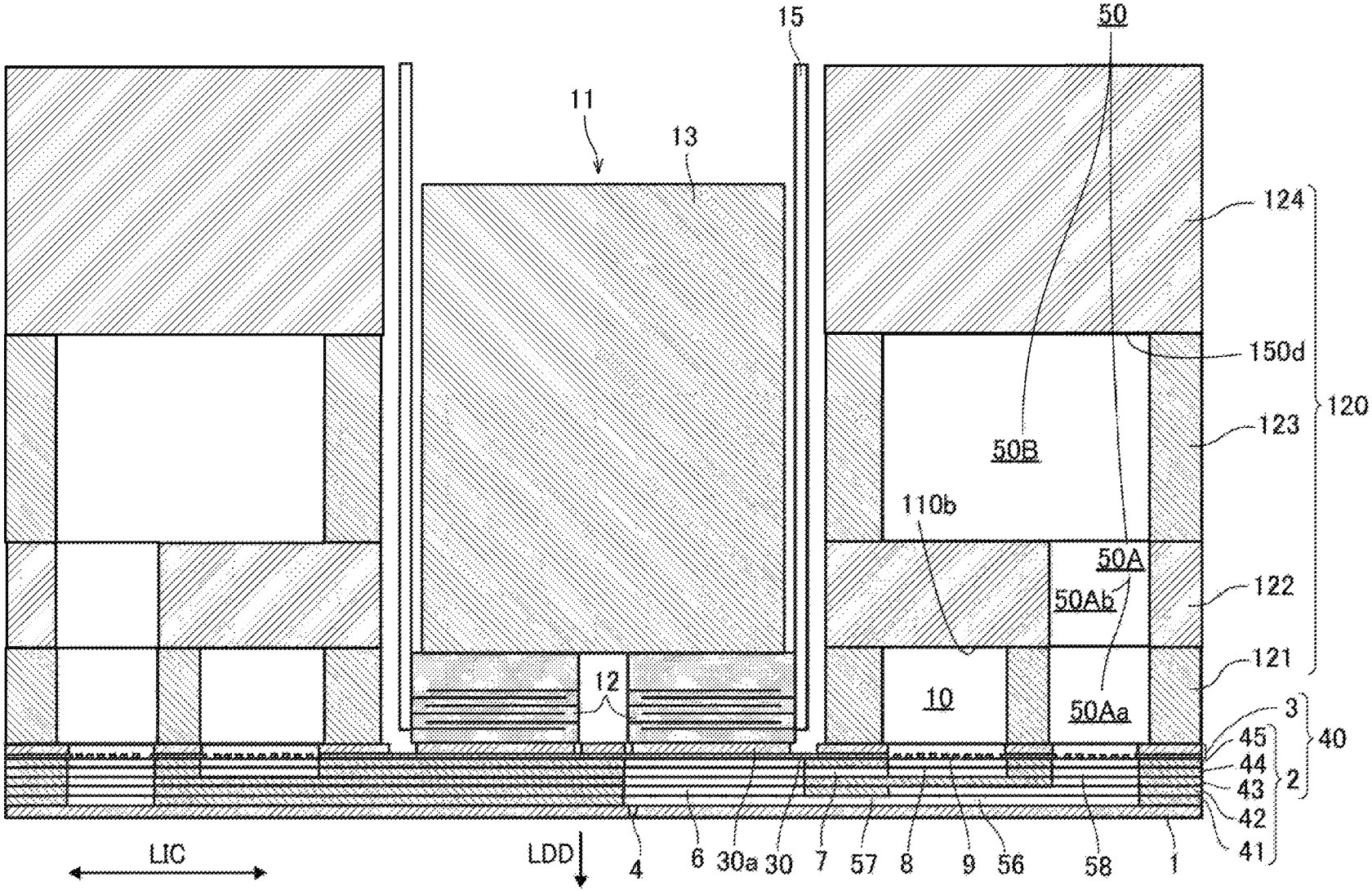
FIG. 12 is an explanatory cross-sectional view in the longitudinal direction of the liquid chamber orthogonal to the nozzle array direction of the liquid discharge head according to a fifth embodiment of the present disclosure.

Next, a head 100 according to a fifth embodiment of the present disclosure is described referring to FIGS. 12 and 13A to 13D. FIG. 12 is an explanatory cross-sectional view in a longitudinal direction LIC of the individual chamber 6 orthogonal to a nozzle array direction NAD of the head 100, and FIGS. 13A to 13D are explanatory plan views of respective members constituting a common chamber member of the head 100.

In the present embodiment, a common chamber member 120 includes four members including: at least three laminated members of a first common chamber member 121, a second common chamber member 122, and a third common chamber member 123; and a housing member 124 also functioning as a fourth common chamber member. Meanwhile, similar to a second common chamber member 22 in above-described embodiments, a member in which a wall portion formed by the housing member 124 is closed can be also used as the third common chamber member 123.

The first common chamber member 12.1 contacts the second common chamber member 122, and the second common chamber member 122 contacts the third common chamber member 123.

Here, the first common chamber member 121 is one of two members consecutively located in a lamination direction among the three members. The lamination direction is parallel to the discharge direction LDD of the liquid form the nozzle 4.

Figure 13A:
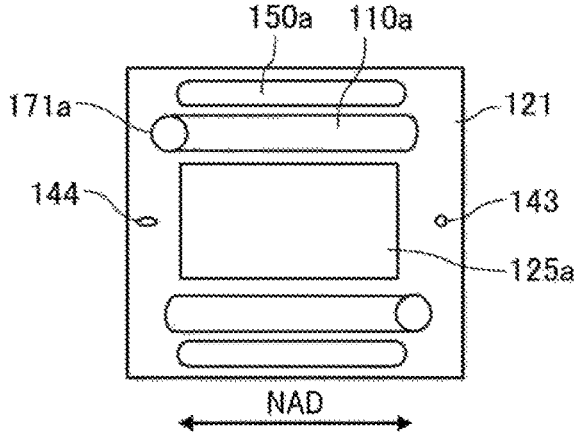
FIGS. 13A to 13D are explanatory plan views of respective members constituting a common chamber member of the liquid discharge head.

As illustrated in FIG. 13A, the first common chamber member 121 includes: a through-hole 125*a* for a piezoelectric actuator; a through-groove 110*a* that is a through-hole portion to be a supply-side common chamber 10; and a through-groove 150*a* that is a through -hole portion to be an upstream recovery-side common chamber 50A*a*.

Figure 13B:
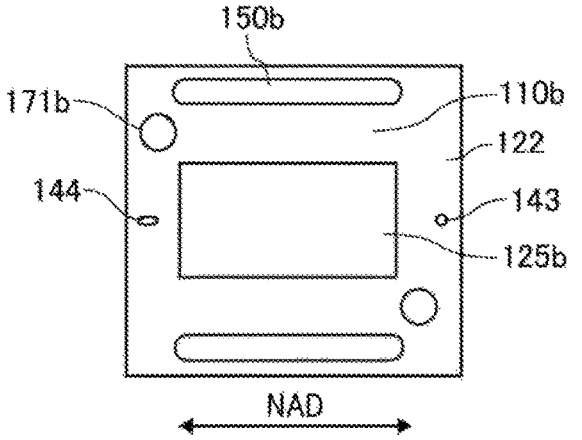

The second common chamber member 122 is one of the two members consecutively located in the lamination direction among the three members. As illustrated in FIG. 13B, the second common chamber member 122 includes: a through-hole 125*b* for a piezoelectric actuator; and a through-groove 150*b* that is a through-hole portion to be a recovery-side common chamber 50Ab. Additionally, the second common chamber member 122 includes a wall portion (wall surface) 110*b* of the supply-side common chamber 10.

Figure 13C:
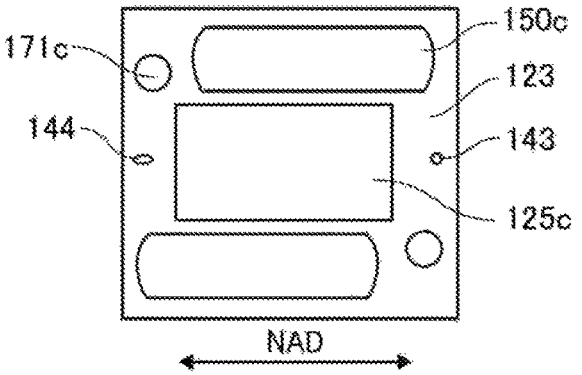

As illustrated in FIG. 13C, the third common chamber member 123 includes: a through-hole 125*c* for a piezoelectric actuator; and a through-groove 150*c* that is a through -hole portion to be a downstream recovery-side common chamber 50B.

Figure 13D:
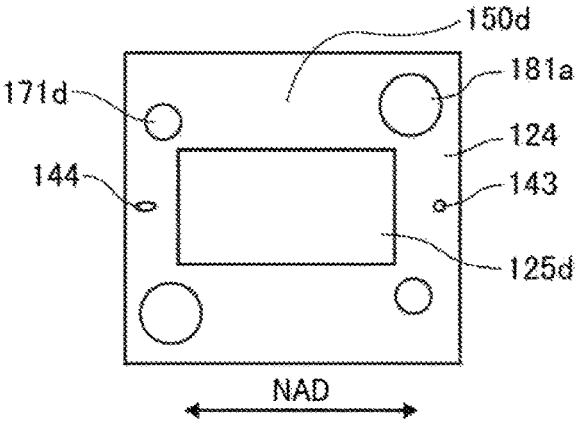

As illustrated in FIG. 13D, the housing member 124 includes a through-hole 125*d* for a piezoelectric actuator. The housing member 124 has a wall portion (wall surface) 150*d* of the downstream recovery-side common chamber 50B.

Additionally, the housing member 124 includes a through-hole 181*a* to allow communication between one end portion in the nozzle array direction NAD of the downstream recovery-side common chamber 50B and a recovery port 81.

Additionally, the first common chamber member 121, the second common chamber member 122, the third common chamber member 123, and the housing member 124 respectively include through-holes 171*a*, 171*b*, 171*c*, and 171*d* to allow communication between another end portion in the nozzle array direction NAD of the supply-side common chamber 10 (end portion opposite to the through-hole 181*a*) and a supply port 71.

Note that a reference hole 143 and a long hole 144, which are alignment marks at the time of assembly, are also provided in each of the first common chamber member 121, the second common chamber member 122, the third common chamber member 123, and the housing member 124.

Figure 14:
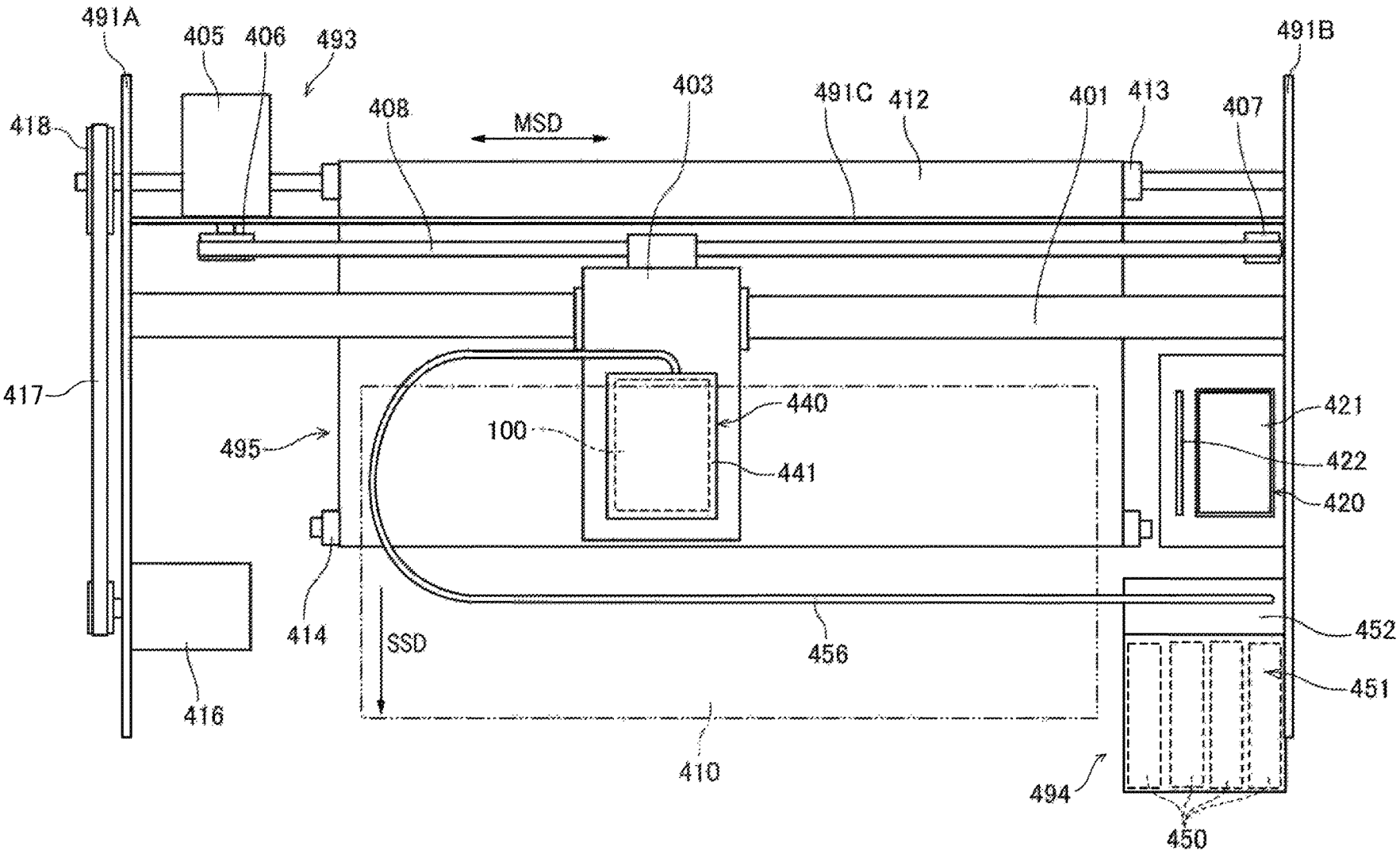
FIG. 14 is an explanatory plan view of a main portion in an exemplary liquid discharge apparatus according to an embodiment of the present disclosure.
Figure 15:
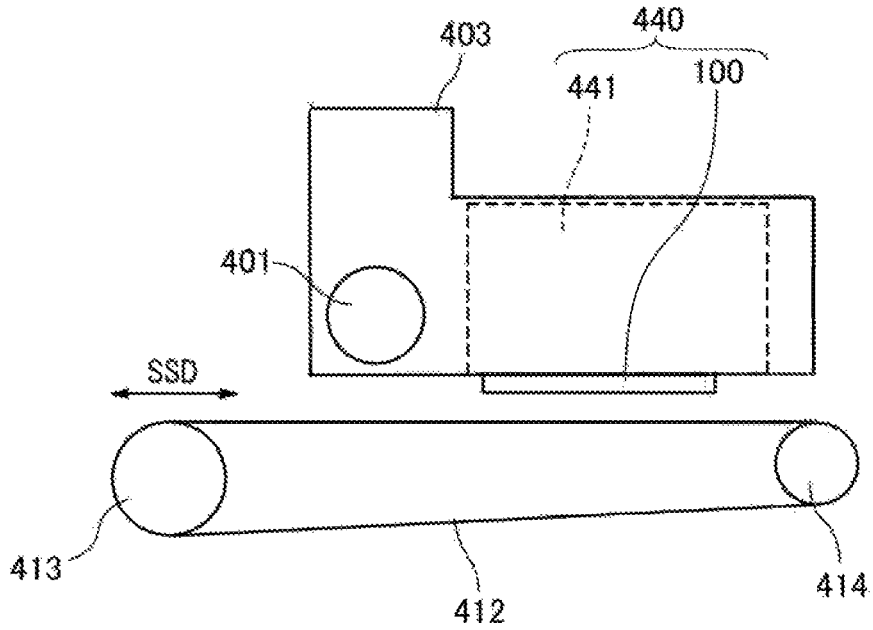
FIG. 15 is an explanatory side view of the main portion of the liquid discharge apparatus.

Next, an exemplary liquid discharge apparatus according to the present disclosure is described referring to FIGS. 14 and 15. FIG. 14 is an explanatory plan view of a main portion in the apparatus, and FIG. 15 is an explanatory side view of the main portion of the liquid discharge apparatus.

This liquid discharge apparatus is a serial head apparatus, and a carriage 403 reciprocally moves in a main-scanning direction by a main scan moving unit 493. The main -scanning direction is indicated by arrow MSD in FIG. 14.

The main scan moving unit 493 includes a guide member 401, a main scanning motor 405, a timing belt 408, and the like. The guide member 401 is bridged between left and right side plates 491A and 491B to hold the carriage 403 in a movable manner. The carriage 403 reciprocally moves in the main-scanning direction MSD by the main scanning motor 405 via the tithing belt 408 bridged between a driving pulley 406 and a driven pulley 407.

The carriage 403 includes a liquid discharge device 440 incorporating a head 100 according to the present disclosure and a head tank 441. The head 100 of the liquid discharge device 440 discharges liquid of each color such as yellow (Y), cyan (C), magenta (M), or black (K). Additionally, the head 100 has nozzle rows arranged in a sub-scanning direction orthogonal to the main-scanning direction MSD, and each nozzle row includes a plurality of nozzles attached while having a discharge direction LDD of the liquid oriented downward. The sub-scanning direction is indicated by arrow SSD in FIG. 14.

Liquid stored in a liquid cartridge 450 is supplied to the head tank 441 by a supply device 494 to supply the head 100 with liquid stored outside the head 100.

The supply device 494 includes: a cartridge holder 451 which the liquid cartridge 450 is attached to and functions as a filling unit; a tube 456; a liquid transfer unit 452 including a liquid transfer pump; and the like. The liquid cartridge 450 is detachably attached to the cartridge holder 451. The liquid is transferred to the head tank 441 from the liquid cartridge 450 by the liquid transfer unit 452 via the tube 456.

The liquid discharge apparatus includes a conveyance mechanism 495 to convey a sheet 410. The conveyance mechanism 495 includes a conveyance belt 412 as a conveying unit and a sub-scanning motor 416 to drive the conveyance belt 412.

The conveyance belt 412 adsorbs the sheet 410 and conveys the sheet at a position facing the head 100. The Conveyance belt 412 is an endless belt and stretched between a conveyance roller 413 and a tension roller 414. A sheet can be adsorbed by electrostatic adsorption, air suction, or the like.

The conveyance belt 412 is rotated in the sub-scanning direction SSD by rotation of the conveyance roller 413 via a timing belt 417 and a timing pulley 418 by the sub-scanning motor 416.

Additionally, a maintenance unit 420 to maintain and recover the head 100 is arranged beside the conveyance belt 412 on one side in the main-scanning direction MSD of the carriage 403.

The maintenance unit 420 includes, for example: a cap member 421 to cap a nozzle surface (surface where a nozzle is formed) of the head 100; a wiper member 422 to wipe the nozzle surface; and the like.

The main scan moving unit 493, supply device 494, maintenance unit 420, and Conveyance mechanism 495 are installed in a casing including side plates 491A and 491B and a rear plate 491C.

In the liquid discharge apparatus thus structured, the sheet 410 is supplied onto the conveyance belt 412 and adsorbed, and the sheet 410 is conveyed in the sub-scanning direction SSD by the circular movement of the conveyance belt 412.

Accordingly, while the carriage 403 is moved in the main-scanning direction MSD, liquid is discharged to a stopped sheet 410 by driving the head 100 in accordance with an image signal to form an image.

Thus, since the liquid discharge apparatus includes the head 100 according to the present disclosure, it is possible to stably form a high-quality image.

Figure 16:
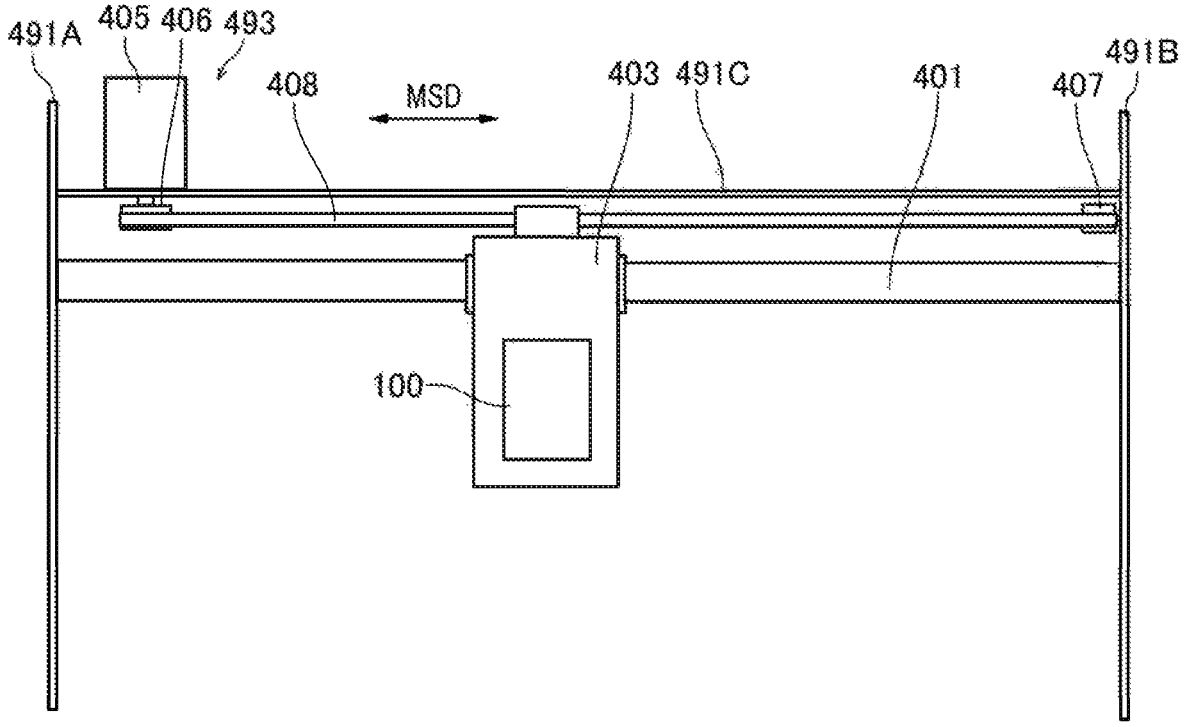
FIG. 16 is an explanatory plan view of a main portion in another exemplary liquid discharge device according to an embodiment of the present disclosure.

Next, another exemplary liquid discharge device according to the present disclosure is described referring to FIG. 16. FIG. 16 is an explanatory plan view of a main portion of the liquid discharge device.

The liquid discharge device includes, among the members constituting the above -described liquid discharge apparatus: the casing including the side plates 491A and 491B and rear plate 491C; the main scan moving unit 493, the carriage 403; and the head 100.

Note that it is also possible to form a liquid discharge device in which at least any one of the maintenance unit 420 and the supply device 494 described above is additionally installed at the side plate 491B of the above-described liquid discharge device.

Figure 17:
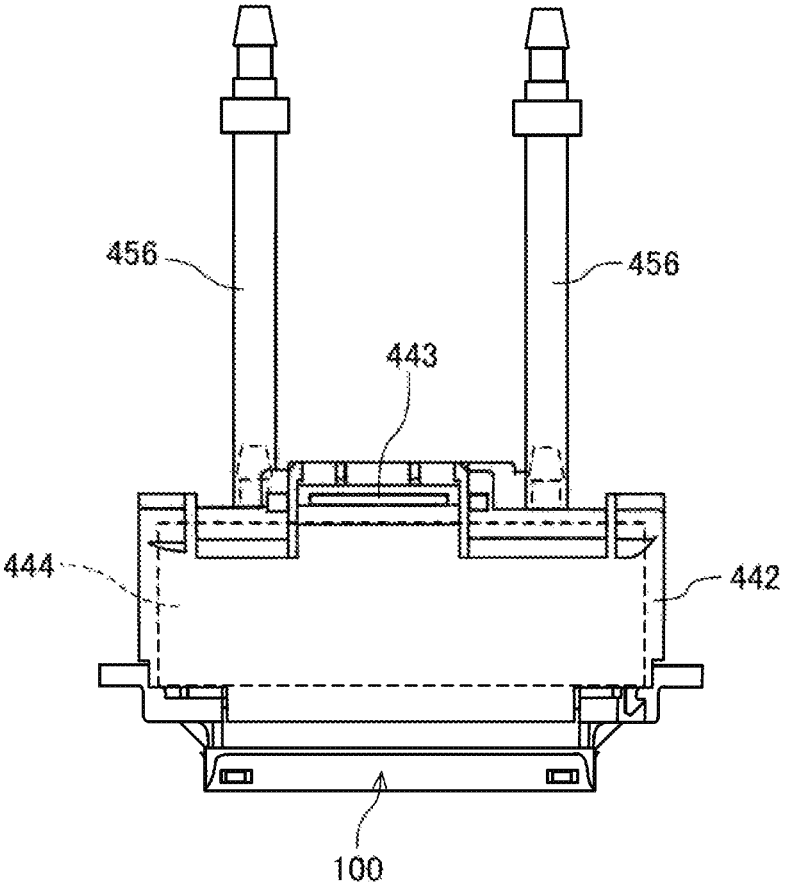
FIG. 17 is an explanatory front view of another exemplary liquid discharge device according to an embodiment of the present disclosure.

Next, still another exemplary liquid discharge device according to the present disclosure is described referring to FIG. 17. FIG. 17 is an explanatory front view of the liquid discharge device.

This liquid discharge device includes: the head 100 in which a channel component 444 is installed; and the tube 456 coupled to the channel component 444.

Note that the channel component 444 is arranged on an inner side of a cover 442. The head tank 441 can also be included instead of the channel component 444. Additionally, a connector 443 allowing electrical connection with the head 100 is provided above the channel component 444.

Figure 18:
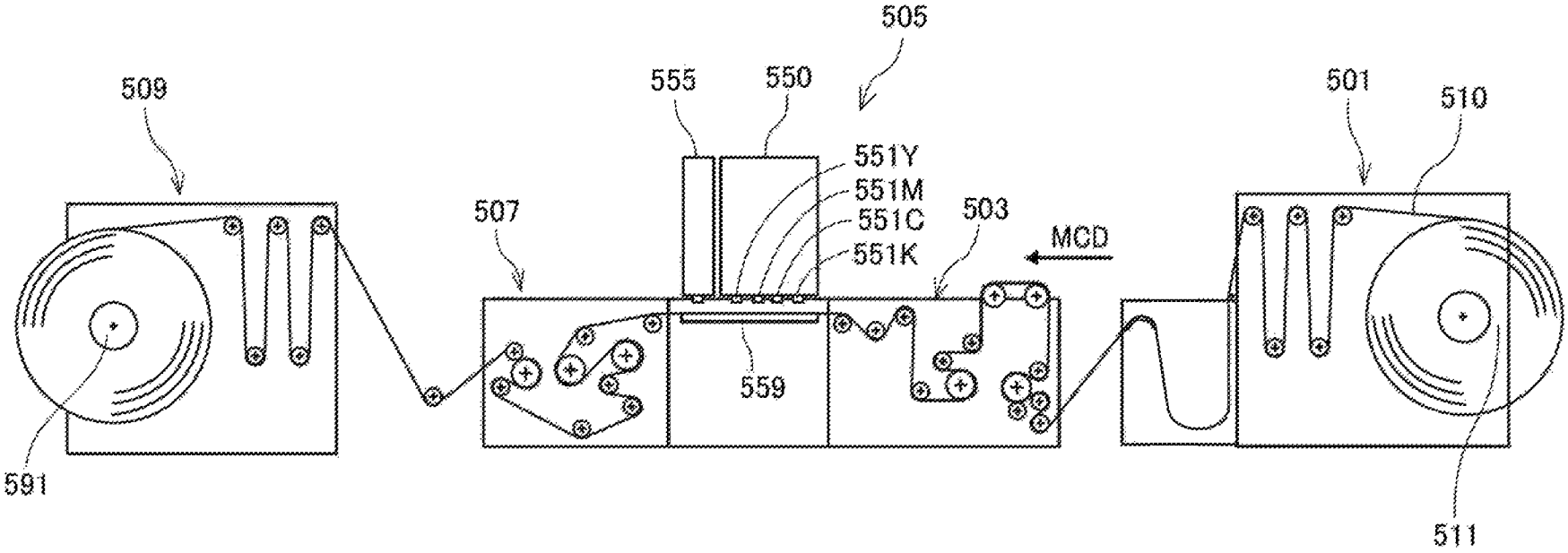
FIG. 18 is an explanatory schematic view of another exemplary liquid discharge apparatus according to an embodiment of the present disclosure.
Figure 19:
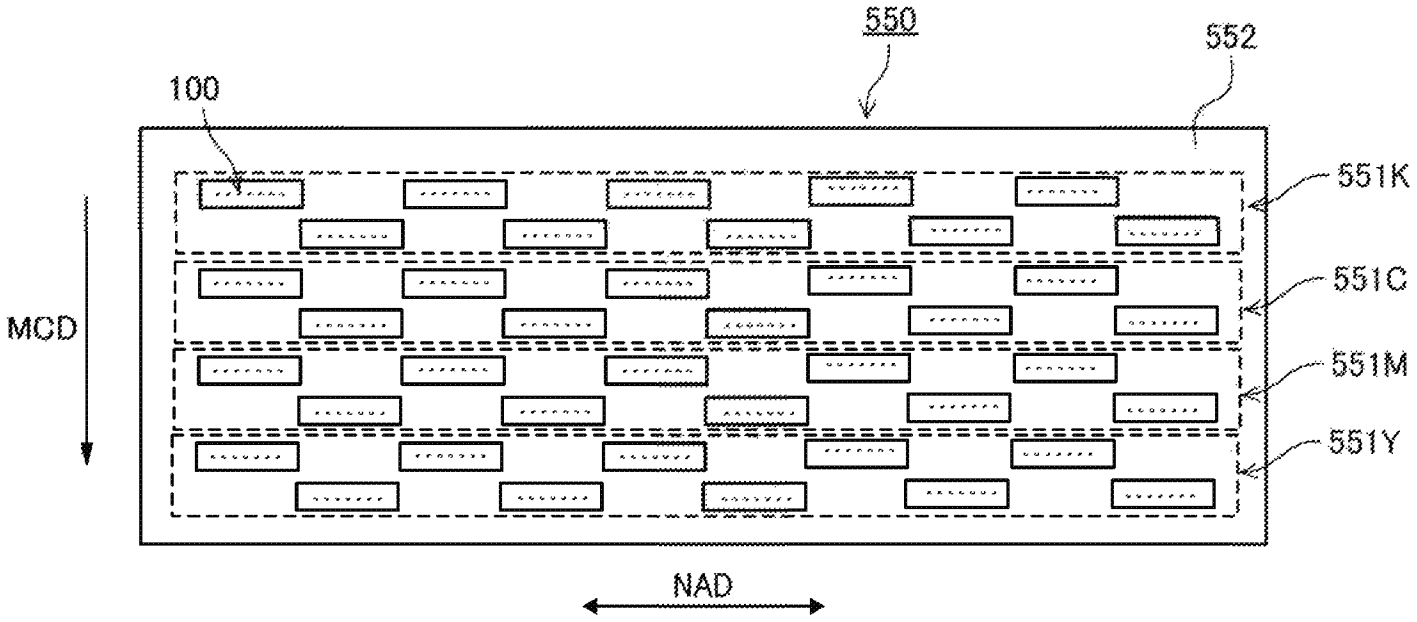
FIG. 19 is an explanatory plan view of the liquid discharge head unit of the liquid discharge apparatus.

Next, another exemplary liquid discharge apparatus according to the present disclosure is described referring to FIGS. 18 and 19. FIG. 18 is an explanatory schematic view of the liquid discharge apparatus, and FIG. 19 is an explanatory plan view of a head unit of the liquid discharge apparatus.

This liquid discharge apparatus includes: a carrying-in unit 501 to carry a continuous medium 510 in; a guide conveying unit 503 to guide and convey the continuous medium 510 carried in from the carrying-in unit 501 to a printing unit 505; the printing unit 505 to perform printing by discharging liquid to the continuous medium 510 to form an image; a drying unit 507 to dry the continuous medium 510; a carrying-out unit 509 to carry the continuous medium 510 out; and the like.

The continuous medium 510 is sent out from a root winding roller 511 of the carrying-in unit 501, guided and conveyed by respective rollers of the carrying-in unit 501, guide conveying unit 503, drying unit 507, and carrying-out unit 509, and then wound up by a winding-up roller 591 of the carrying-out unit 509.

In the printing unit 505, the continuous medium 510 is conveyed on a conveyance guide member 559 disposed to face a head unit 550 and a head unit 555, and an image is formed by using liquid discharged from the head unit 550 and then subjected to post -treatment with treatment liquid discharged from the head unit 555.

In the head unit 550, for example, full-line head arrays for four colors of 551K, 551C, 551M, and 551Y (hereinafter, each referred to as "head array 551" in a case of not distinguishing one color from the other) are arranged from an upstream side in a medium conveyance direction indicated by arrow MCD in FIGS. 18 and 19.

Each head array 551 is a liquid discharging unit, and discharges liquid of black K, cyan C, magenta M, or yellow Y onto the conveyed continuous medium 510. Note that a color type and number of colors are not limited to the four colors.

For example, each head array 551 is formed by arranging, on a base member 552, a plurality of the heads 100 according to the present disclosure in a staggered manner.

Figure 20:
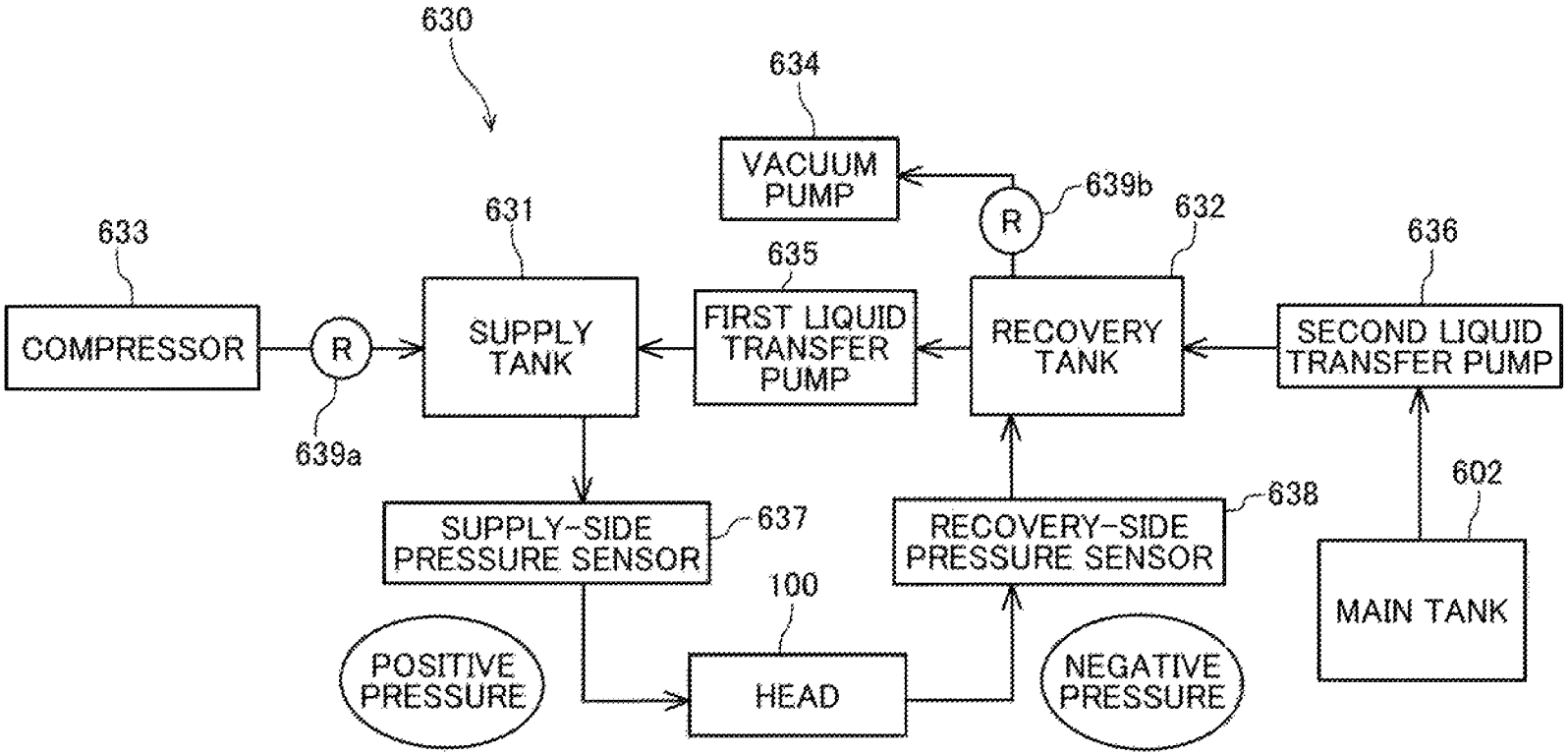
FIG. 20 is an explanatory block diagram to describe an exemplary liquid circulation system in the liquid discharge apparatus.

Next, an example of a liquid circulation system in the liquid discharge apparatus is described referring to FIG. 20. FIG. 20 is an explanatory block diagram to describe the liquid circulation system.

A liquid circulation system 630 includes a main tank 602, the head 100, a supply tank 631, a recovery tank 632, a compressor 633, a vacuum pump 634, a first liquid transfer pump 635, a second liquid transfer pump 636, a supply-side pressure sensor 637, a recovery-side pressure sensor 638, regulators (R) 639*a* and 639*b*, and the like.

The supply-side pressure sensor 637 is coupled to a supply-side channel located between the supply tank 631 and the head 100 and linked to a supply port 71 of the head 100. The recovery-side pressure sensor 638 is coupled to a recovery-side channel located between the head 100 and the recovery tank 632 and linked to a recovery port 81 of the head 100.

The recovery tank 632 has one side coupled to the supply tank 631 via the first liquid transfer pump 635, and the recovery tank 632 has the other side coupled to the main tank 602 via the second liquid transfer pump 636.

With this structure, liquid flows from the supply tank 631 through the supply port 71 into the head 100, is recovered from the recovery port 81 to be recovered in the recovery tank 632. The liquid is further transferred from the recovery tank 632 to the supply tank 631 by the first liquid transfer pump 635, and consequently, the liquid is circulated.

Additionally, a compressor 633 is linked to the supply tank 631 and controlled so that a predetermined positive pressure is detected by the supply-side pressure sensor 637. On the other hand, a vacuum pump 634 is linked to the recovery tank 632 and controlled so that a predetermined negative pressure is detected by the recovery-side pressure sensor 638.

Thus, the negative pressure of a meniscus can be kept constant while the liquid is circulated through the inside of the head 100.

When the liquid is discharged from the nozzle 4 of the head 100, a liquid amount in each of the supply tank 631 and the recovery tank 632 is decreased. Therefore, the liquid is replenished from the main tank 602 to the recovery tank 632 as necessary by using the second liquid transfer pump 636. Timing to replenish the liquid from the main tank 602 to the recovery tank 632 can be controlled by a detection result of a liquid level sensor provided inside the recovery tank 632. For example, the liquid can be replenished when a liquid level inside the recovery tank 632 becomes lower than a predetermined liquid level.

In the present application, the liquid to be discharged may have any viscosity and surface tension at which the liquid can be discharged from the head, and the liquid is not particularly limited.

However, preferably, the viscosity of the liquid is not greater than 30 mPa·s under ordinary temperature and ordinary pressure or by heating or cooling. Examples of the liquid include solution, suspension, or emulsion containing, for example, a solvent such as water or an organic solvent, a colorant such as dye or pigment, a functional material such as a polymerizable compound, a resin, or a surfactant, a biocompatible material such as DNA, amino acid, protein, or calcium, or an edible material such as a natural colorant. Such solution, suspension, or emulsion can be used for, e.g., inkjet ink, surface treatment solution, liquid used to form components of an electronic element, a light-emitting element, a resist pattern of an electronic circuit, or material solution for three-dimensional fabrication.

Examples of an energy source to generate energy to discharge the liquid include a piezoelectric actuator (a laminated piezoelectric element or a thin-film piezoelectric element), a thermal actuator that employs a thermoelectric conversion element such as a heating resistor, and an electrostatic actuator including a diaphragm and opposed electrodes.

The "liquid discharge device" includes an assembly of parts relating to liquid discharge, and represents a structure including the head and a functional part(s) or mechanism combined to the head. For example, the "liquid discharge device" may include a combination of the head with at least one of a head tank, a carriage, a supply device, a maintenance unit, and a main scan moving unit.

Examples of the integrated Unit include a combination in which, for example, a head and one or more functional parts and devices are secured to each other through, e.g., fastening, bonding, or engaging, and a combination in which one of the head and the functional parts and devices is movably held by another. Furthermore, the head, the functional parts, and the mechanism may be detachable from each other.

Examples of the liquid discharge device further include a head integrated with the head tank. In this case, the head and the head tank may be coupled to each other with a tube. Furthermore, a filter portion may be disposed between the head tank and the head of liquid discharge device.

The head and the carriage may form the "liquid discharge device" as a single unit.

In still another example, the liquid discharge device includes the head movably held by the guide member constituting a part of the main scan moving unit so that the head and the main scan moving unit form a single unit. The head, carriage, and main scan moving unit may form a single unit. In still another example, the cap member constituting a part of the maintenance unit is secured to the carriage mount on the head so that the head, the carriage, and the maintenance unit form a single unit to form the liquid discharge device.

Examples of the liquid discharge device further include a head in which a head is integrated with a supply device in such a manner that the head mounted with a head tank or a channel component is coupled to a tube. Through this tube, liquid in a liquid storage source is supplied to the head.

The main scan moving unit may also include the guide member only. The supply device may include only a tube(s) or only a loading unit.

The term "liquid discharge apparatus" used herein is an apparatus including the head or the liquid discharge device to drive the head to discharge liquid. The liquid discharge apparatus may be, for example, an apparatus capable of discharging liquid to a material to which liquid can adhere and an apparatus that discharges liquid toward gas or into liquid.

The "liquid discharge apparatus" May include devices to feed, convey, and eject the material to which liquid can adhere, and may further include a pretreatment apparatus, a post -treatment apparatus, and the like.

The "liquid discharge apparatus" may be, for example, an image forming, apparatus to form an image on a sheet by discharging ink, or a three-dimensional fabrication apparatus to discharge fabrication liquid to a powder layer in which powder is formed in layers to form a three-dimensional fabrication object.

The "liquid discharge apparatus" is not limited to an apparatus to discharge liquid to visualize meaningful images, such as letters or figures. For example, the liquid discharge apparatus includes an apparatus to form meaningless images, such as meaningless patterns, or fabricate three-dimensional images.

The above-described term "material to which liquid can adhere" denotes, for example, a material or a medium to which liquid adheres at least temporarily, a material or a medium to which liquid adheres and is fixed, or a material or a medium which liquid adheres to and which the liquid permeates. Examples of the "material onto which liquid can adhere" include recording media such as a sheet, a recording sheet, and a recording medium such as a film, cloth, or the like, electronic components such as an electronic substrate and a piezoelectric element, and media such as a powder layer, an organ model, and a testing cell. The "material onto which liquid can adhere" includes any material onto which liquid adheres unless particularly limited.

The above-described "material to Which liquid can adhere" may be any material as long as liquid such as paper, thread, a fiber, cloth, leather, metal, plastic, glass, wood, ceramics, or the like can temporarily adhere.

Additionally, the "liquid discharge apparatus" may be an apparatus to relatively move the head and a material to which liquid can adhere. However, the liquid discharge apparatus is not limited to such an: apparatus. For example, the "liquid discharge apparatus" may be a serial head apparatus that moves the head, a line head apparatus that does not move the head, or the like.

Examples of the "liquid discharge apparatus" further include a treatment liquid coating apparatus to discharge the treatment liquid to a sheet to coat a surface of the sheet with treatment liquid to reform the surface of the sheet, an injection granulation apparatus in which composition liquid including raw materials dispersed in solution is sprayed through nozzles to granulate fine particles of the raw, materials.

The terms "image forming", "recording", "printing", "image printing", and "fabricating" used herein may be used synonymously with each other.

Numerous additional modifications and variations are possible in light of the above teachings. It is therefore to-be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge head comprising:

a plurality of nozzles to discharge a liquid;

a plurality of individual chambers communicating with the plurality of nozzles, respectively;

a supply-side common chamber communicating with each of the plurality of individual chambers; and a recovery-side common chamber communicating with each of the plurality of individual chambers, wherein the supply-side common chamber and a part of the recovery-side common chamber are aligned in a longitudinal direction of the plurality of individual chambers orthogonal to a nozzle array direction along which the plurality of nozzles is arrayed.

2. The liquid discharge head according to claim 1, wherein the supply-side common chamber is disposed to overlap with another part of the recovery-side common chamber in a discharge direction of the liquid from the plurality of nozzles.

3. The liquid discharge head according to claim 1, wherein a width of the supply-side common chamber is wider than a width of the part of the recovery-side common chamber in the longitudinal direction.

4. The liquid discharge head according to claim 1, further comprising .a filter portion arranged to face the supply-side common chamber.

5. The liquid discharge head according to claim 1, further comprising a filter portion arranged to face the supply-side common chamber and the part of the recovery-side common chamber.

6. The liquid discharge head according to claim 1, further comprising at least two laminated members, wherein one of the two laminated members contacting with each other includes a first through-hole portion to be the part of the recovery-side common chamber and a second through -hole portion to be the supply-side common chamber, and another of the two laminated members contacting with each other includes a wall of the supply-side common chamber disposed above the second through-hole portion and a third through-hole portion to be another part of the recovery-side common chamber.

7. The liquid discharge head according to claim 1, further comprising at least three laminated members, wherein one of two laminated members contacting with each other among the at least three laminated members includes a first through-hole portion to be the part of the recovery -side common chamber and a second through-hole portion to be the supply-side common chamber, and another of the two laminated members contacting with each other includes a wall of the supply-side common chamber disposed above the second through-hole portion and a third through-hole portion to be another part of the recovery-side common chamber.

8. A liquid discharge device comprising the liquid discharge head according to claim 1.

9. The-liquid discharge device according to claim 8, wherein the liquid discharge head and at least one of ahead tank to store liquid to be supplied to the liquid discharge, head, a carriage on which the liquid discharge head is mounted, a supply device to supply liquid to the liquid discharge head, a maintenance unit to maintain the liquid discharge head, and a main scan moving unit to move the liquid discharge head in a main-scanning direction form the liquid discharge device as a single unit.

10. A liquid discharge apparatus comprising the liquid discharge device according to claim 8.

* * * * *